United States Patent [19]

Cherrington

[11] 4,176,985

[45] Dec. 4, 1979

[54] SYSTEM AND METHOD FOR INSTALLING PRODUCTION CASINGS

[75] Inventor: Martin D. Cherrington, Carmichael, Calif.

[73] Assignee: Reading and Bates Construction Co., Houston, Tex.

[21] Appl. No.: 740,570

[22] Filed: Nov. 10, 1976

Related U.S. Application Data

[63] Continuation-in-part of Ser. No. 595,830, Jul. 14, 1975, Pat. No. 4,043,136.

[51] Int. Cl.[2] ..... F16L 1/04

[52] U.S. Cl. ..... 405/184; 175/61; 405/154

[58] Field of Search ..... 61/42, 84, 85, 72.7, 61/105; 175/62, 61, 171

[56] References Cited

U.S. PATENT DOCUMENTS

| | | | |
|---|---|---|---|
| 3,589,135 | 6/1971 | Ede | 61/105 |
| 3,830,545 | 8/1974 | Sugden | 175/62 X |
| 3,894,402 | 7/1975 | Cherrington | 175/62 X |

OTHER PUBLICATIONS

Oil & Gas Journal, Jan. 26, 1959—vol. 57, No. 4, p. 105.

*Primary Examiner*—David H. Corbin

*Attorney, Agent, or Firm*—Townsend and Townsend

[57] ABSTRACT

A system and method for emplacing a relatively large casing under and spanning an obstacle such as a river is disclosed. A liquid-occupied passageway is excavated along an arcuate path beneath the obstacle between positions at or near ground level on either side. A casing of lesser diameter than the passageway is introduced into the passageway following the excavating apparatus. A transport fluid is introduced at the excavating site to entrain the cuttings resulting from the excavating. The casing is non-rotatably advanced along the arcuate path of the passageway, and the transport fluid and entrained cuttings are collected in the interior of the leading end of the casing. The transport fluid and entrained cuttings are evacuated under positive pressure from the interior of the leading portion of the casing to prevent the cuttings from settling in the ground circumscribing the advancing casing. The interior of the casing is sealed off proximate the leading portion thereof to provide buoyancy to the casing in the passageway. The casing is weighted to substantially neutralize the buoyancy of the casing and thereby minimize friction between the casing and the sidewalls of the passageway to facilitate advancement of the casing into the passageway.

7 Claims, 6 Drawing Figures

SYSTEM AND METHOD FOR INSTALLING PRODUCTION CASINGS

This is a continuation-in-part of my copending application of the same title, Ser. No. 595,830, filed July 14, 1975 now U.S. Pat. No. 4,043,136.

FIELD OF THE INVENTION

The present invention relates to a system and method for emplacing a casing under a surface obstacle such as a river.

DESCRIPTION OF THE PRIOR AND CONTEMPORANEOUS ART

Techniques have recently been developed for installing relatively large diameter casings beneath rivers and other surface obstacles without dredging the riverbed or otherwise altering the obstacle itself. Often, a pilot hole is first drilled from a position at or near the surface on one side of the obstacle to a position at or near ground level on the other side. See my U.S. Pat. No. 3,878,903 entitled APPARATUS AND METHOD FOR DRILLING UNDERGROUND ARCUATE PATHS issued Apr. 22, 1975. After drilling the pilot hole, the pilot drill string used to drill the pilot hole remains in the hole. A reamer is then attached to one end of the drill string and is drawn or forced through the pilot hole about the pilot string to ream the pilot hole to a preselected larger diameter. The production casing or other large diameter casing moves into the reamed annulus about the pilot string in the pilot hole in following relationship to the reaming apparatus. As a result, when the pilot hole has been reamed from one end to the other, the larger casing occupies the reamed hole.

In the recently developed techniques discussed above for installing casings along the path of a pilot hole, the cuttings from the reamer are entrained in drilling mud. The reamed pilot hole has a slightly greater diameter than the outer diameter of the casing, and the drilling mud containing the entrained cuttings flows out of the hole through the annular space circumscribing the casing. It has been found that as long as the drilling mud containing the entrained cuttings flows along casing, the casing will move smoothly into the hole because the flowing drilling mud greatly reduces friction between the casing and the sides of the reamed pilot hole.

The above method of placing large diameter casings beneath surface obstacles has proved to be quite effective when relatively short distances are to be traversed. However, where large crossings must be made, such as under a river which can be up to one mile wide, with large casings, the above techniques have proved to be ineffective. As the large casing is being advanced into the ground, the pressure at which the drilling mud must be forced into the hole so that it will flow along the outside of the large casing increases. In relatively soft ground such as a riverbed, the drilling mud at such higher pressures acts to hollow out the reamed pilot hole, greatly increasing the volumetric rate of flow of the drilling mud required to maintain a continuous flow of such mud into the out of the reamed hole. As the distance along which the large casing has been advanced increases, the volumetric rate of flow and the pressure required to maintain continuous flow increase in a nonlinear fashion because of the hollowing out of the hole. Eventually, either the capacity of the pumps injecting the drilling mud into the hole is exceeded or the hole blows out through soil strata near its leading end, and the continuous flow of the drilling mud out of the hole along the outside of the large casing ceases.

When the flow of drilling mud along the outer surface of the large casing stops, the cuttings will remain in the hole and accumulate. The stationary cuttings will thus surround the casing as it is being advanced into the hole, and the lubricity of the fluid is lost. The coefficient of friction of the casing relative to the circumscribing ground will increase dramatically and typically freeze the casing in the hole. Once movement of the casing stops, the static coefficient of friction must be overcome to further advance the casing, which is larger than the dynamic coefficient of friction and the casing ordinarily cannot be moved and remains frozen in the hole.

As the casing is being advanced into the hole, it will be forced against the circumscribing ground, resulting in large frictional forces which can freeze the casing into the hole. The hole is generally below the water table, especially if a river crossing is being attempted, and is ordinarily filled with water or a mud slurry. If the casing is sealed and the interior does not contain a liquid, the casing will be buoyant and will be forced against the top of the hole. If the casing is not sealed, the weight of the casing will force it against the bottom of the hole. In either event, relatively large frictional forces will result between the casing and the hole. For example, if a 42" diameter, half inch wall thickness stell casing is used, the casing weighs approximately 221 pounds per foot, and if the interior of the casing is not sealed, this represents dead weight which must be forced through the hole. On the other hand, if such casing is sealed, it will have a buoyancy resulting in a force of approximately 426 pounds per foot against the top of the hole. The resulting frictional forces in either case clearly become excessive when large casings are installed under obstacles which may be over 1,000 feet wide.

SUMMARY OF THE INVENTION

The present invention provides a system and method for emplacing a relatively large casing under and spanning an obstacle such as a river. A liquid-occupied passageway is excavated along an arcuate path beneath the obstacle between positions at or near ground level on either side. A casing of lesser diameter than the passageway is introduced into the passageway following the excavating apparatus. The transport fluid is introduced at the excavating site to entrain the cuttings resulting from the excavating. The casing is non-rotatably advanced along the arcuate path of the passageway, and the transport fluid and entrained cuttings are collected in the interior of the leading end of the casing. The transport fluid and entrained cuttings are evacuated under positive pressure from the interior of the leading portion of the casing to prevent the cuttings from settling in the ground circumscribing the advancing casing. The interior of the casing is sealed off proximate the leading portion thereof to provide buoyancy to the casing in the passageway. The casing is weighted to substantially neutralize the buoyancy of the casing and thereby minimize friction between the casing and the sidewalls of the passageway to facilitate advancement of the casing into the passageway.

In the system of the present invention, the drilling mud with the entrained cuttings does not flow along the outer surface of the casing as with existing systems.

Instead, the drilling mud is collected within the casing itself so that it cannot hollow out the hole, and evacuated from the hole under pressure. Hollowing out of the hole had resulted in nonlinear increases in the pressure and volumetric flow required to maintain continuous flow of the drilling mud in the past, but is avoided with the present invention. Substantially all of the cuttings are removed from the hole as the drilling mud passes out of the hole through the interior of the casing. Because the drilling mud flows through the interior of the casing rather than around the outside of the casing, the flow will be continuous. The cuttings cannot become trapped in the space surrounding the casing to freeze the casing in place and prevent further movement thereof, a common occurrence in prior systems.

The drilling mud containing the entrained cuttings is forced along the interior of the casing by impelling apparatus located within the casing near the leading end thereof. In one preferred embodiment of the present invention, the impelling means comprises an auger extending at least part way from the leading end of the casing to the trailing end. In other embodiments, positive displacement pumps are used. In addition, suction can be provided at the trailing end of the casing. Such systems facilitate the continuous cycling of drilling mud into and out of the hole to insure that all cuttings are removed therefrom.

When the system of the present invention is used, ground water will ordinarily fill any space which remains in the hole circumscribing the casing. Such ground water will provide natural flotation and lubrication of the casing. In addition, if desired, a lubricating fluid can be injected into this space to further facilitate the advancing of the casing into the hole. The present invention provides for weighting the casing so that its weight or buoyancy in the hole is neutralized and the casing will float into the hole.

Typically, the system of the present invention employs several conduits passing through the casing which supply and/or evacuate drilling mud and other fluids from at or near the excavating site at the leading end of the casing. Other conduits for air, guidance and electrical systems may also pass through the casing. In the system of the present invention, the size and configuration of such conduits are preferably selected so that their weight plus the weight of their contents closely approximates the weight necessary to counteract the buoyancy of the casing. The thickness of the casing itself can also be selected to at least partially compensate for its buoyancy. In addition, the specific gravity of the various fluids in the internal conduits can be precisely controlled to control the buoyant tendencies of the casing. The fluids should be pumped by positive displacement pumps so that the amount of fluids in the conduits can be closely metered. Independent weighting systems may also be used. These factors allow relatively accurate monitoring of the buoyancy of casing so that it can be neutralized and friction forces between the casing and the surrounding ground can be kept to an absolute minimum, and the casing can readily be floated into the hole.

The novel features which are believed to be characteristic of the invention, both as to organization and method of operation, together with further objects and advantages thereof will be better understood from the following description considered in connection with the accompanying drawings in which preferred embodiments of the invention are illustrated by way of example. It is to be expressly understood however, that the drawings are for the purpose of illustration and description only and are not intended as a definition of the limits of the invention.

DESCRIPTION OF THE PREFERRED EMBODIMENTS

Figure 1:
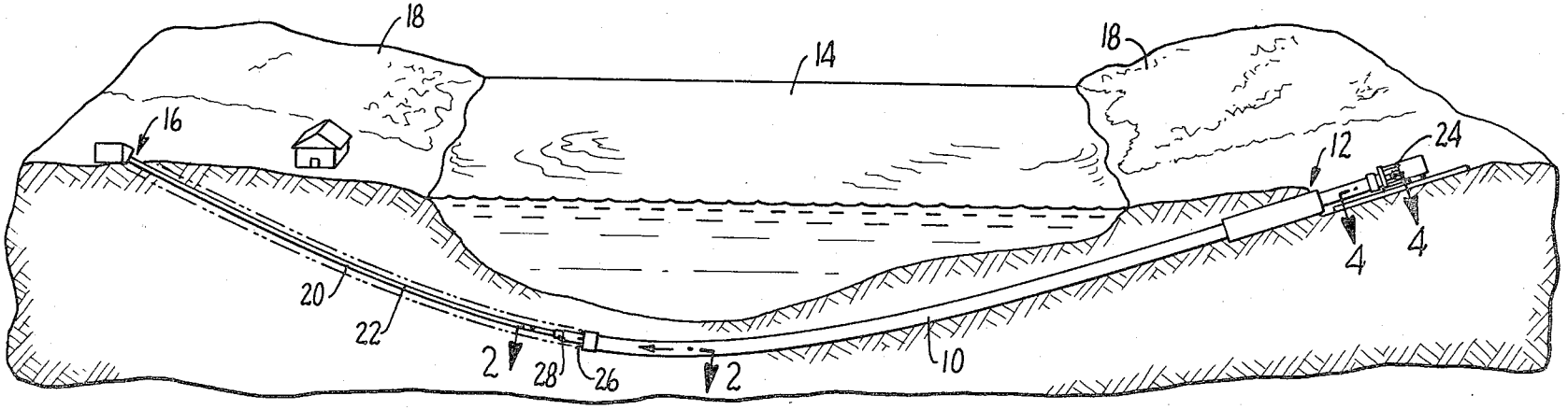
FIG. 1 is a perspective view of the installation of a production casing according to the teachings of the first embodiment of the present invention.

The present invention provides a method for implacing a production casing 10 along an invert underground arcuate path, as illustrated in FIG. 1. The path extends from a first position 12 on one side of a surface obstacle such as a river 14 to a second position 16 on the other side of the obstacle. Positions 12 and 16 are at or near the surface of the ground 18 surrounding river 14, and thus it is necessary that the path have an inverted arcuate shape as illustrated.

1. First Embodiment

The first embodiment of the present invention applies to drilling techniques wherein a pilot hole 20 is initially drilled along the chosen inverted underground arcuate path from the first position 12 on one side of river 14 to a second position 16 at the other side. Such techniques are demonstrated in my U.S. Pat. No. 3,878,903 issued Apr. 22, 1975, for APPARATUS AND PROCESS FOR DRILLING UNDERGROUND ARCUATE PATHS. The pilot hole is drilled using a drill bit having a trailing string 22 which occupies the pilot hole from one end to the other after the pilot hole has been completed.

In the system and method of the first embodiment, production casing 10 is advanced into and along the path of pilot hole 20 by a rig 24 located at the first position 12 on one side of river 14. As described in more detail hereinbelow, production casing 10 is advanced in following relationship to a reamer 26. Reamer 26 is mounted to the outer circumference of a washover pipe 28 which is advanced along the path of pilot hole 20 circumscribing pilot drill string 22. The cuttings from reamer 26 are entrained in drilling mud which is forced through the interior of casing 12 and out of the hole.

Figure 2:
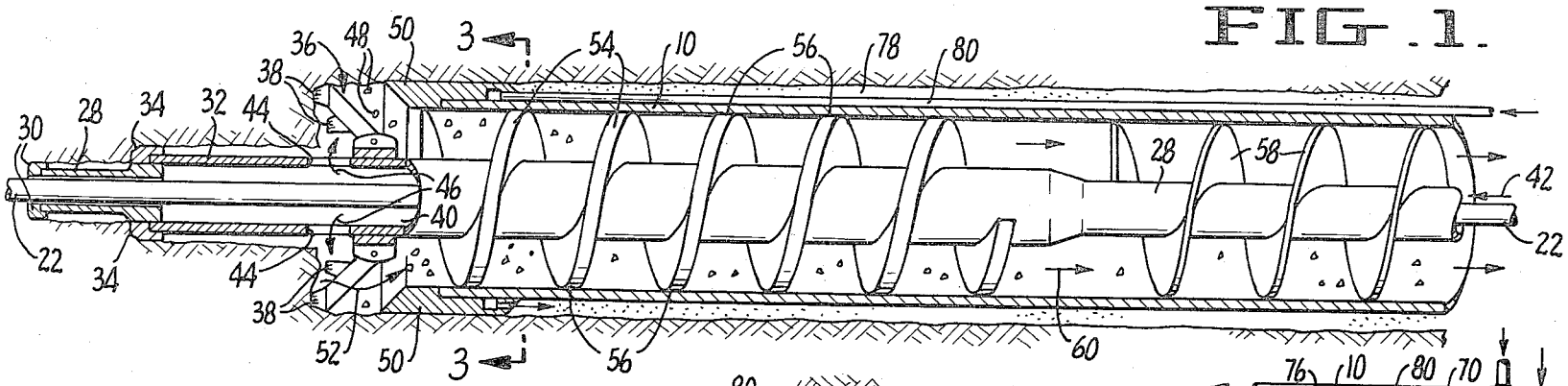
FIG. 2 is a sectional view taken along lines 2—2 of FIG. 1.

The first embodiment is illustrated in more detail by way of reference to FIG. 2. Washover pipe 28 is provided with a plurality of teeth 30 at its leading end to open a path for the washover pipe as it is advanced along the path of the pilot hole around pilot drill string 22. A larger diameter, thick walled section 32 is interposed in washover pipe 28. A plurality of cutting teeth 34 are located at the leading end of large diameter section 32 to expand the hole to accommodate the width of the larger diameter section. Large diameter section 32 is followed by the remainder of the relatively smaller diameter washover pipe 28.

A reaming apparatus 36 having a plurality of flipout teeth 38 is mounted to washover pipe 28 along the outer circumference of larger diameter section 32. As washover pipe 28 is being advanced into and along pilot string 22, it is rotated by rig 24 (See FIG. 1) so that reamer teeth 38 ream the pilot hole to a larger diameter to accommodate production casing 10.

Figure 4:
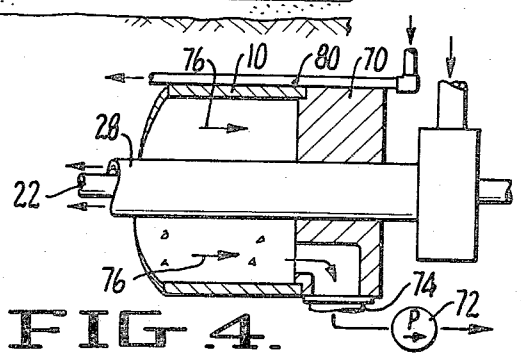
FIG. 4 is a sectional view taken along lines 4—4 of FIG. 1.

As washover pipe 28 is being advanced and rotated to operate reaming apparatus 36, drilling mud is injected through the annular space 40 between pilot string 22 and washover pipe 28, as illustrated by arrow 42. The drilling mud is pumped into annular space 40 through a conduit 43 at the trailing end of washover pipe 28, as illustrated in FIG. 4. One or more apertures 44 are provided in washover pipe 28 adjacent reaming apparatus 36. The drilling mud injected through the annular space between washover pipe 28 and drill string 22 exits through apertures 44 proximate reamer 36, as illustrated by arrows 46. The cuttings 48 from reaming apparatus 36 are entrained in the drilling mud.

Production casing 10 is advanced into and along the inverted arcuate path of pilot hole 20 by rig 24, as illustrated in FIG. 1. It is preferred that production casing 10 be advanced nonrotatably into the ground, particularly when large diameter casings are used, to minimize stress caused by rotating the casing when it has an arcuate configuration. Casings with built in curvature may be used which cannot be rotated. However, it may be desirable in some circumstances to advance the production casing rotatably into the ground. In any such situation, production casing 10 is advanced so that the leading end thereof follows immediately behind reaming apparatus 36.

Figure 3:
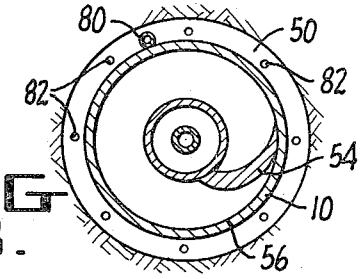
FIG. 3 is a sectional view taken along lines 3—3 of FIG. 2.

A pack-off blade 50 is mounted to the leading end of production casing 10 (see FIG. 2). Pack-off blade 50 circumscribes the leading end of the production casing and provides a sealing contact between the outer surfaces of the reamed pilot hole and production casing 10, as also illustrated in FIG. 3. Because of this sealing contact, the drilling mud containing the entrained cuttings from reamer 36 will pass into the leading end of the production casing as illustrated by arrow 52. Passage of the drilling mud containing the entrained cuttings into any annular space between the outer surface of production casing 10 and the inner surface of the reamed pilot hole is substantially prevented.

A relatively heavy auger flight 54 is mounted to the outer circumference of the large diameter segment 32 of washover pipe 28 immediately behind reaming apparatus 36. The blade portion of auger 54 has a relatively thick transverse dimension and provides a flat bearing surface 56 at its outer edges. Since pilot drill string 22 follows an arcuate path, relatively large transverse loads will be imposed by leading auger flight 54 against the interior walls of production casing 10. Accordingly, auger flight 54 with its wide bearing surfaces 56 is provided to withstand such transverse loads. In addition, auger flight 54 is mounted to the relatively large diameter segment 32 of washover pipe 28 so that such transverse loads do not cause failure of the washover pipe.

Leading auger flight 54 impells the drilling mud containing the entrained cuttings 48 from reaming apparatus 36 from the leading end of production casing 10 toward the trailing end. Additional auger flights such as 58 may be mounted to washover casing 28 following auger flight 54 to further impell the drilling mud and the entrained tailings rearwardly, as illustrated by arrow 60. If desired, such auger flights may extend all the way to the trailing end of production casing 10.

In order to further insure that the drilling mud containing the entrained tailings is completely evacuated from the reamed pilot hole, suction may be provided at the trailing end of the production casing as illustrated in FIG. 4. A pack-box 70 is attached to the trailing end of production casing 10 to provide a seal between the production casing and washover pipe 28. A pump 72 communicates with the interior of production casing 10 through conduit 74. Pump 72 sucks the drilling mud containing the entrained tailings along the interior of casing 10, as illustrated by arrows 76, and out of the production casing.

Referring back to FIG. 2, it is apparent that the outer diameter of pack-off blade 50 is greater than the outer diameter of production casing 10. Accordingly, an annular void 78 will be left circumscribing the production casing. Void 78 will typically be filled with ground water to lubricate passage of production casing 10 along the path of the reamed pilot hole.

It may be desirable to inject a high lubricity fluid into void 78 to further facilitate the advancing of production casing 10 into the reamed pilot hole. Accordingly, a supply pipe 80 is mounted to the exterior of production casing 10, and extends from the trailing end illustrated in FIG. 4 to pack-off blade 50. A high lubricity fluid is injected into conduit 80 at the trailing end of production casing 10 to pack-off blade 50, in which it is distributed to and dispersed by a plurality of orifices 82, as illustrated in FIG. 3. The high lubricity fluid exiting orifices 82 serves to further lubricate the passage of production casing 10 into the pilot hole.

In operation with respect to the first embodiment, a pilot hole is initially drilled along an inverted underground arcuate path beneath the obstacle such as river 14 to be traversed. The pilot drill string 22 is left in the pilot hole. A washover casing 28 is then advanced and simultaneously rotated into and along the path of the pilot hole circumscribing pilot string 22. The reaming apparatus 36 attached to washover pipe 28 reams the pilot hole to a preselected diameter to accommodate the production casing.

Production casing 10 is advanced into and along the reamed pilot hole in following relationship to reaming apparatus 36. Pack-off blade 50 provides a seal between casing 10 and the sidewalls of the reamed pilot so that the drilling mud containing the cuttings from the reamer flows into the interior of the advancing casing. Auger 54 on rotating washover pipe 28 impells the drilling mud containing the entrained cuttings from the leading end of the production casing toward the trailing end thereof. Movement of the drilling mud containing the entrained trailings along production casing 10 is facilitated by the suction provided by pump 72 at the trailing end of the casing. In this manner, the drilling mud and the entrained tailings are substantially completely evacuated from the hole.

Complete evacuation of the drilling mud containing the entrained cuttings is desired so that the cuttings do not interfere with the progress of the production casing into the hole. In the present invention such cuttings will not enter the annular space surrounding the production casing and interfere with the advancing of the casing into the hole. Advancement of the production casing can be further enhanced by injecting a high lubricity fluid into the space circumscribing the production casing.

2. Second Embodiment

Figure 5:
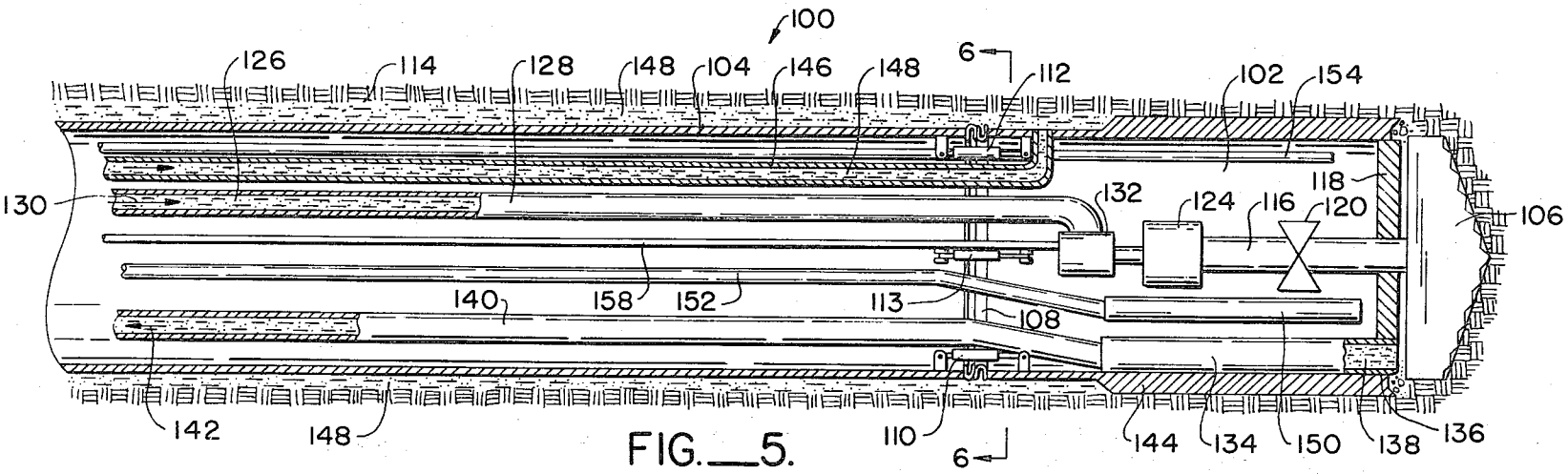
FIG. 5 is a side sectional view of a second embodiment of the system of the present invention.
Figure 6:
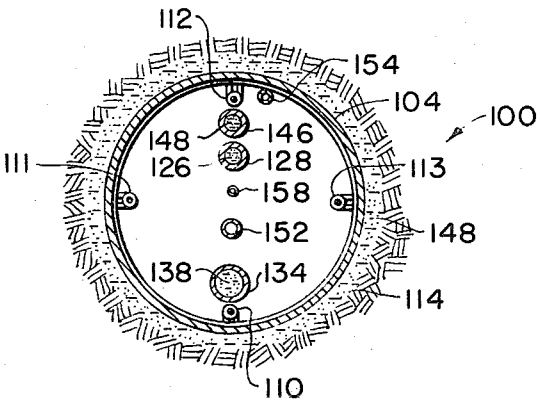
FIG. 6 is a sectional view taken along line 6—6 of FIG. 5.

A second embodiment 100 of the present invention is illustrated by way of reference to FIGS. 5 and 6. With the second embodiment of the present invention, the pilot string is not used to define the arcuate path. Instead, a drill head casing 102 is located at the leading end of production casing 104. Drill head casing 102 is provided with a drill bit 106 which excavates the passage in its entirety along the preferred arcuate path beneath the obstacle in a single step.

Drill head casing 102 is mounted to production casing 104 by means of a flexible bellows-type joint 108 to provide a continuous casing including the drill head and production casings. Joint 108 allows the angular orientation of drill head casing 102 to be adjusted relative to the central axis of the leading end of production casing 104. A plurality of hydraulic actuators 110–113 span flexible joint 108 from production casing 104 to drill head casing 102. Actuators 110–113 can be extended and contracted to control the angular orientation of drill head casing 102 and thus control the path of the passageway 114 excavated by drill bit 106.

Drill bit 106 is mounted on a shaft 116 which passes through a plate 118 which seals off the leading end of drill head casing 102 and thus closes off the leading end of production casing 104. Shaft 116 is mounted on a bearing 120, and is driven by a hydraulic motor 124 powered through conduit 158. Drilling mud 126 is injected through a conduit 128 as illustrated by arrow 130 through a fluid coupling 132 and is expelled at drill bit 106 to entrain the cuttings from the drilling operation.

A positive displacement pump 134 communicates with a port 136 in plate 118. Pump 134 collects the used drilling mud and entrained cuttings 138 from the drilling operation and evacuates the same through a conduit 140 as illustrated by arrow 142. A pack-off blade 144 may circumscribe the leading end of drill head casing 102 and provides a substantially sealing contact with the sidewalls of passageway 114 so that substantially all of the used drilling mud and entrained cuttings are collected and evacuated. Alternatively, drill head casing 102 may be tapered and no pack-off blade or a relatively small blade used.

A conduit 146 is communicated with the annular space circumscribing production casing 104. Lubricating mud 148 is injected through conduit 146 and expelled into the annular void between production casing 104 and the sidewalls of passageway 114. The lubricating mud provides lubrication between production casing 104 and passageway 114 and also causes the casing to float in the passageway. However, even if lubricating mud 148 were not injected into the annular void, water seepage would ordinarily fill the void.

To provide production casing 104 with at least partial buoyancy, a sump pump 150 is located in drill head casing 102. Sump pump 150 drains any water seepage from the interior of production casing 104 and drill head casing 102 and expells the same through conduit 152 so that the casing may be provided for guidance, air supply, electrical connections and other such purposes.

As discussed hereinabove, if the interior of the casing formed by production casing 104 and drill head casing 102 were not sealed, the weight of the production casing and drill head casing would be simply dead weight, and large frictional forces would result between these items and the bottom of passageway 114. However, if production casing 104 and drill head casing 102 are completely sealed and unweighted, the buoyancy of the casing will cause an even greater force to be exerted along the top of the hole. However, these buoyancy forces are counteracted in the system of the present invention by weighting the production casing 104 and drill head casing 102 so that their buoyancy is substantially neutralized, and these items will simply "float" along passageway 114 in lubricating mud 148 and/or surrounding ground water.

The present invention attempts to employ existing apparatus to weight the casing so that neutral buoyancy is achieved. Specifically, the diameter and wall thickness of conduits 146, 128, 152, 140 and 158 are selected so that the weight of the conduits plus their contents result in nearly neutral buoyancy. In addition, the wall thickness of production casing 104 can be selected toward this end. Furthermore, the specific gravity of the drilling mud 126 and lubricating mud 148 can be changed to compensate for any deviation in buoyancy from neutral. Positive displacement pumps such as 134 are used to insure that the flow of such fluids can be closely metered and substantially neutral buoyancy can be achieved.

3. Summary of the Preferred Embodiments

While preferred embodiments of the present invention have been illustrated in detail, it is apparent that modifications and adaptations of those embodiments will occur to those skilled in the art. For example, it is apparent that the second embodiment of the present invention is an improvement over the first embodiment in that further control is placed over the movement of fluids within the casing so that substantially neutral buoyancy can be more readily achieved. However, it is to be expressly understood that further modifications and adaptations of the present invention are to be considered within the scope of the present invention, as defined by the following claims.

What is claimed as new is:

1. A method for emplacing a casing beneath an obstacle between first and second locations at or near to ground level comprising the steps of:

excavating a liquid-occupied passageway having a preselected diameter along an invert arcuate path under said obstacle between said locations; introducing a casing of lesser diameter than said passageway along said passageway thereby defining a region between said casing and said passageway; introducing through a supply conduit within said casing a transport fluid at the site of said excavating; entraining the cuttings from said excavating in the transport fluid; non-rotatably advancing said casing into and along the arcuate path of said passageway; sealing the outer circumference of said casing and the circumscribing ground from the interior of said casing to form a sealed-off annulus; withdrawing said transport fluid and entrained cuttings from the site of said excavating to prevent said cuttings from settling in the ground circumscribing the advancing casing; causing said transport fluid and entrained cuttings to flow through a return conduit within said casing; sealing off the interior of said casing proximate the site of said excavating to provide buoyancy to the casing within the passageway; and selecting the weight and size of said supply and return conduits passing through the interior of said casing so that the weight of said conduits and their respective contents substantially neutralizes said buoyancy to minimize friction between the casing and the sidewalls of the passageway to facilitate advancement of said casing into the passageway.

2. A method according to claim 1 further including introducing a lubricating fluid into said sealed-off annulus, said casing being weighted to substantially neutralize the buoyancy of said casing in said lubricating fluid.

3. A method according to claim 1 wherein said steps of withdrawing and causing the transport fluid and entrained cuttings to flow, together comprise driving a positive displacement pump to evacuate the transport fluid and entrained cuttings under positive pressure from the site of said excavating.

4. Apparatus for emplacing a casing underground beneath an obstacle between first and second locations at or near ground level, said apparatus comprising means for excavating a liquid-occupied passageway having a preselected diameter along an invert arcuate path beneath said obstacle betwee said locations; a casing sealed at the leading end thereof to provide buoyancy; means for introducing and advancing said casing into said passageway following the excavating means, the diameter of said casing being generally less than the diameter of the passageway, thereby to establish an annular void in the ground between the outer circumference of said casing and the inner circumference of the circumscribing ground; means proximate said excavating means for sealing said excavating means from said annular void; supply means within said casing for introducing a transport fluid at said excavating means for entraining cuttings produced by said excavating means; inlet means for permitting said transport fluid and entrained cuttings to enter the interior of the said casing; impelling means for causing said transport fluids and entrained cuttings to enter through said inlet means from said excavating site in sealed-off relation to said annular void; and return means within said casing for providing a path for said transport fluid and entrained cuttings; wherein the weight of said casing, said supply means, said return means, and their respective contents substantially neutralizes the buoyancy of said casing to minimize friction between the casing and the sidewalls of the passageway to facilitate advancement of the casing into the passageway.

5. Apparatus according to claim 4 wherein the casing includes a production casing and a drill head casing located at and sealably joined to the leading end of said production casing, and wherein said sealing means includes means for providing a substantially sealing contact between the outer circumference of said drill head casing and the circumscribing passageway.

6. Apparatus for emplacing a casing along a path beneath an obstacle between first and second locations at or near ground level, said apparatus comprising: a casing sealed at the leading end thereof; means located in front of the leading end of said casing for excavating a passageway along said path; means for introducing and advancing said casing into said passageway following the excavating means, the diameter of said casing being generally less than the diameter of the passageway, thereby to establish an annular void in the ground between the outer circumference of said casing and the inner circumference of the circumscribing ground; means proximate said excavating means for sealing said excavating means from said annular void; supply means within said casing for introducing a transport fluid at said excavating means for entraining cuttings produced by said excavating means; impelling means for evacuating the transport fluid and entrained cuttings from the region proximate said excavating means; return means within said casing for providing a path for said transport fluid and entrained cuttings through the interior of said casing; and means for injecting a lubricating fluid into the annular void between the outer circumference of the casing and the inner circumference of the circumscribing ground; wherein the weight of said supply means, said return means, and their respective contents substantially neutralizes the buoyancy of said casing in said lubricating fluid caused by said casing's being sealed at the leading end thereof to minimize friction between the casing and the sidewalls of the passageway to facilitate advancement of the casing into the passageway.

7. Apparatus according to claim 6 wherein the casing includes a production casing and a drill head casing located at and sealably joined to the leading end of said production casing, and wherein said sealing means includes means for providing a substantially sealing contact between the outer circumference of said drill head casing and the circumscribing passageway.

* * * * *